US011117366B1

(12) United States Patent
McCue

(10) Patent No.: US 11,117,366 B1
(45) Date of Patent: Sep. 14, 2021

(54) LIGHT IMAGING RETROFIT KIT FOR COMPUTER TO SCREEN PRINTER

(71) Applicant: Geoff McCue, Tonganoxie, KS (US)

(72) Inventor: Geoff McCue, Tonganoxie, KS (US)

( * ) Notice: Subject to any disclaimer, the term of this patent is extended or adjusted under 35 U.S.C. 154(b) by 0 days.

(21) Appl. No.: 17/119,493

(22) Filed: Dec. 11, 2020

(51) Int. Cl.
*B41F 15/14* (2006.01)
*B41F 15/08* (2006.01)

(52) U.S. Cl.
CPC ..... *B41F 15/14* (2013.01); *B41F 15/08* (2013.01); *B41P 2200/40* (2013.01); *B41P 2215/10* (2013.01)

(58) Field of Classification Search
CPC ..... B41F 15/08; B41F 15/14; B41P 2200/40; B41P 2215/10
See application file for complete search history.

(56) References Cited

U.S. PATENT DOCUMENTS 5,156,089 A * 10/1992 McCue ..... B41C 1/147 101/128.4
5,580,698 A * 12/1996 Andersen ..... H04N 1/04 430/308
5,875,712 A * 3/1999 Ericsson ..... B41C 1/14 101/129
2006/0130679 A1* 6/2006 DuBois, III ..... B41C 1/12 101/128.4
2008/0019721 A1* 1/2008 Okano ..... G03G 15/5041 399/52

* cited by examiner

*Primary Examiner* — Matthew G Marini
*Assistant Examiner* — Marissa Ferguson-Samreth
(74) *Attorney, Agent, or Firm* — Intellectual Property Consulting, LLC; Stephen M. Kepper

(57) ABSTRACT

A retrofit kit that upgrades an existing inkjet printing mechanism by replacing it with a more efficient and advanced light imaging mechanism. The kit includes a control module, a printhead module, and a retrofit printhead. The control module is operable to communicate with the existing command processor in order to receive a digital image. The retrofit printhead includes a means for emitting light onto an emulsion coated screen and is adapted to attach to and be integrated into an existing XY plotting system within the existing printer. The control module interfaces with the existing command processor to control the XY plotting system and the position of the retrofit printhead. The control module also interfaces with the printhead module to communicate and synchronize the amount of light to be emitted at each position; the printhead module thereafter controls the retrofit printhead to emit the determined amount of light at each position.

9 Claims, 5 Drawing Sheets

LIGHT IMAGING RETROFIT KIT FOR COMPUTER TO SCREEN PRINTER

FIELD

The present invention relates in general to computer to screen printers. More specifically, the present invention relates to a retrofit kit that allows an existing inkjet computer-to-screen printer to be upgraded to a light imaging computer-to-screen printer.

BACKGROUND

Traditionally, screens for screenprinting have been made by coating a mesh with a photosensitive emulsion, compressing it with a film positive of the desired image, exposing it to light, then washing away the unexposed areas. The technology evolved over the last 20 years to having an inkjet printer print the image directly on the emulsioned screen and then expose it to light. Most recently, the technology evolved into using projected light onto the emulsioned screen and directly exposing just the imaged areas using either the Texas Instruments Digital Light Processor (DLP also known as Digital Mirror device DMD) or some other form of laser technology. These later light imaging technologies do not use a consumable such as the ink for the inkjet printer.

Over the last 20 years, several hundred inkjet machines have been sold around the world. The trade name for these devices is computer-to-screen or CTS. Some manufacturers use the term direct-to-screen or DTS. These machines utilize XY plotters with an inkjet head attached to them for printing purposes. The newer light imaging systems and printers also use XY plotters with light imaging devices attached. Exemplary embodiments of the newer light imaging devices include the CST DLE-ECO and Sign Tronic STM-MICRO.

With imaging technology improving all the time, it becomes necessary to upgrade or replace older, outdated equipment. Accordingly, there is a need for an economic solution that allows a user to upgrade his or her existing inkjet computer-to-screen printer with light imaging technology. The disclosed retrofit or upgrade kit solves this need by providing the tools and software, in kit form, that allow an existing inkjet printer to be upgraded with the newer, more technical light imaging mechanisms.

BRIEF SUMMARY OF THE INVENTION

The present invention is a retrofit kit that allows a person to upgrade an existing inkjet printing mechanism by replacing it with a more efficient and advanced light imaging mechanism. The kit includes a control module, a printhead module, and a retrofit printhead. The control module is operable to communicate with the existing command processor in order to receive a digital image. The retrofit printhead includes a means for emitting light onto an emulsion coated screen and is adapted to attach to and be integrated into an existing XY plotting system within the existing printer. After receiving the digital image, the control module interfaces with the existing print computer to control the XY plotting system and the position of the retrofit printhead. The control module also interfaces with the printhead module to communicate and synchronize the amount of light to be emitted at each position; the printhead module thereafter controls retrofit printhead to emit the determined amount of light at each position, and the process is repeated until a negative print of the digital image is printed onto the emulsion coated screen.

In one embodiment the means for emitting light from the retrofit printhead includes a light source, a digital micromirror device, and a focus lens. The micromirror is operable to modulate the light in the form of an image segment that is then projected through the focus lens onto the emulsion coated screen.

In another embodiment, the means for emitting light from the retrofit printhead includes a plurality of light emitting or laser diodes operable to emit light, a focus lens operable to project the light onto the emulsion coated screen, and a plurality of fiberoptic threads operable to transmit light from the diodes to the focus lens.

In another embodiment, the means for emitting light from the retrofit printhead includes a plurality of light emitting or laser diodes attached to a plurality of fiberoptic threads operable to transmit light directly onto an emulsion coated screen.

In another embodiment, the means for emitting light from the retrofit printhead includes a plurality of laser diodes attached to a plurality of fiberoptic threads operable to transmit light from the laser diodes through an orifice plate onto an emulsion coated screen.

In another embodiment, the means for emitting light from the retrofit printhead includes a plurality of laser diodes operable to transmit light directly onto an emulsion coated screen.

In another embodiment, the means for emitting light from the retrofit printhead includes a plurality of laser diodes operable to transmit light from the laser diodes through an orifice plate onto an emulsion coated screen.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
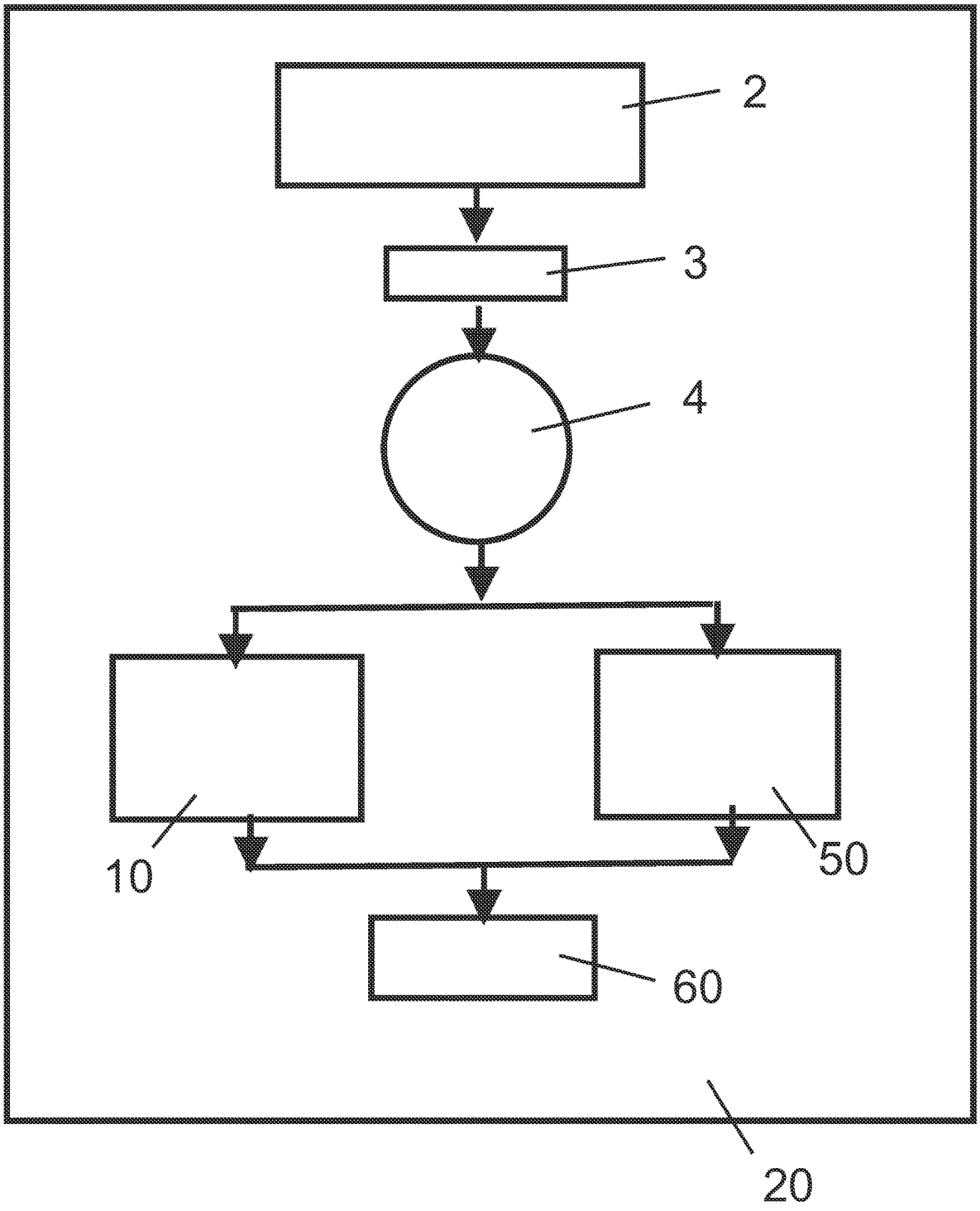
FIG. 1 depicts a system for a computer-to-screen printer in the prior art.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

For a further understanding of the nature and function of the embodiments, reference should be made to the following detailed description. As used herein, "axis" means a real or imaginary straight line about which a three-dimensional body is symmetrical.

FIG. 1 depicts a system for a typical inkjet CTS printer 20 known in the art. These systems include hardware in the form of a XY plotting system 10 (as detailed in FIGS. 2-3) and an inkjet head 50 as well as internal command processors 4 operable to receive a digital image 2 and communicate commands to the XY plotting system 10 and inkjet head 50 to print the image onto an emulsion coated screen 60. Typically, these CTS printers 20 include a raster image processor 3 (RIP) which converts the digital image into a raster image (or bitmap). The command processor 4 within these existing CTS printers 20 is operable to receive the raster image and communicate commands to the XY plotting system 10 and inkjet head 50 to print the image onto the emulsion coated screen 60.

Figure 2:
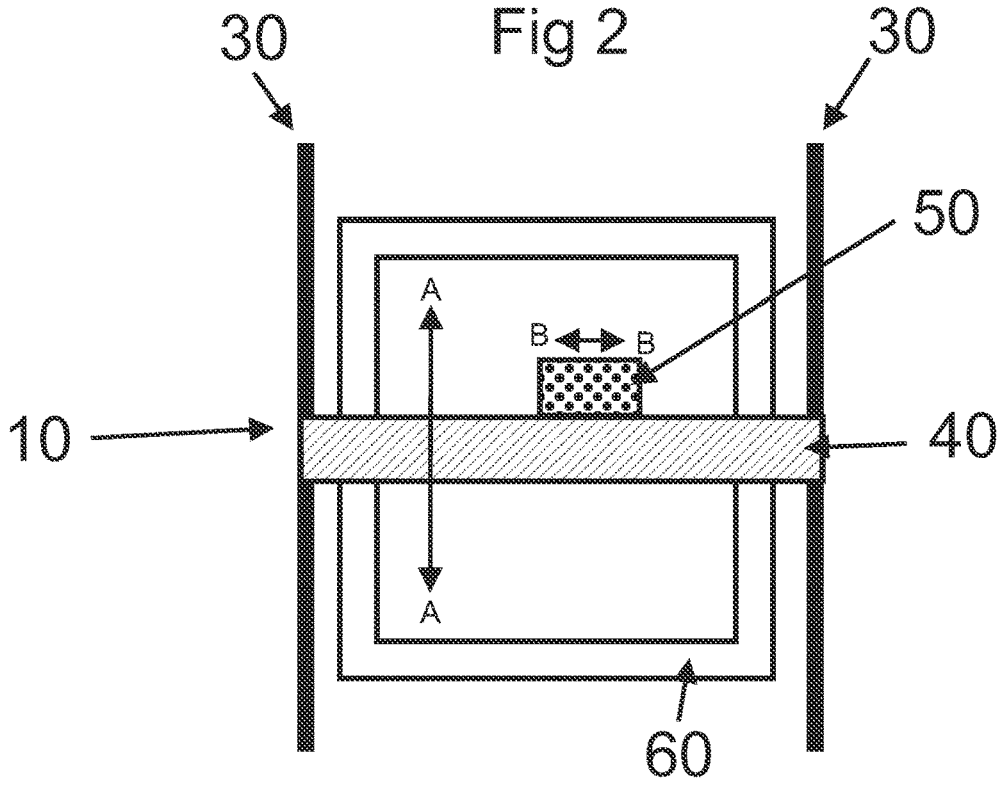
FIG. 2 depicts a XY plotting system used in a computer-to-screen printer in the prior art.
Figure 3:
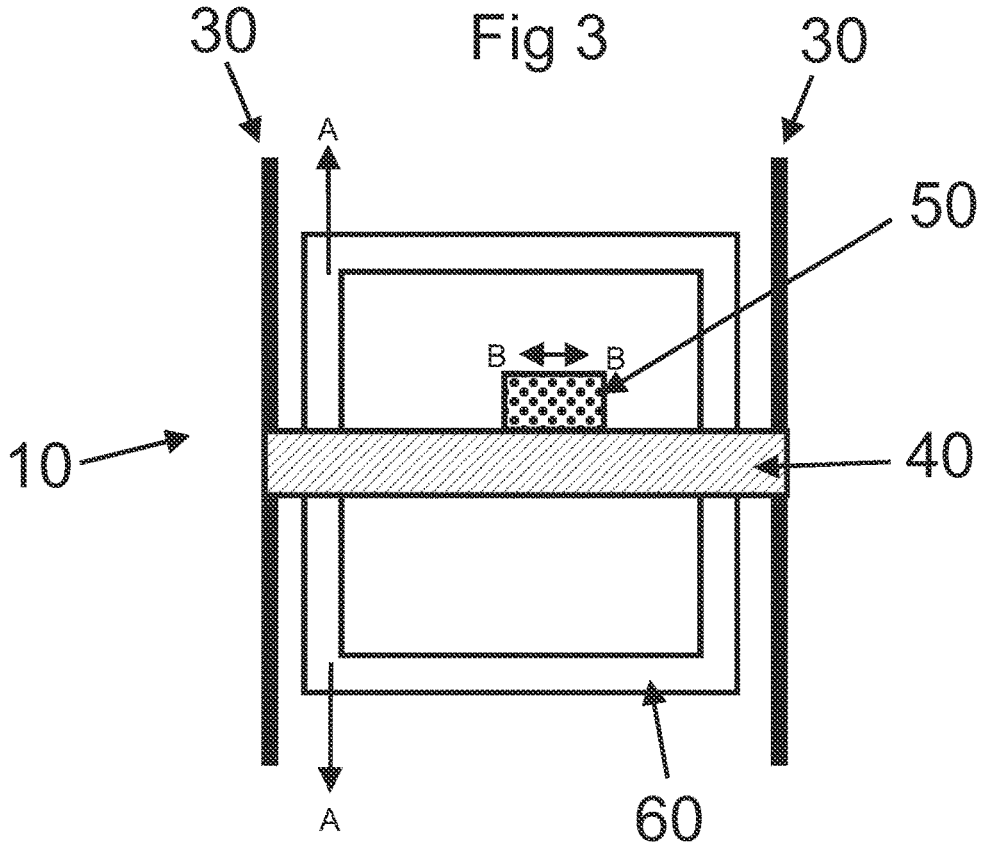
FIG. 3 depicts an alternative XY plotting system used in a computer-to-screen printer in the prior art.

FIGS. 2-3 depict exemplary embodiments of XY plotting systems 10 known in the art of CTS inkjet printers 20. These XY plotting systems 10 include a series of longitudinal rails 30 and a transverse bar 40 mountably attached to the rails 30. The inkjet head 50 is connected to the transverse bar 40, and the combination of parts allows the inkjet head 50 to freely move along a longitudinal axis A-A and a lateral axis B-B. Exemplary embodiments of these printers include the Douthitt CTS 30 Wax Ink Printer, M&R i-Image STE & STE II (Model Nos. 36-1, 36-1, 36-3, 43-1, 43-2, and 43-3), and the Lawson Express Jet CTS Inkjet Printer (including Model No. v5 CTS #2536). As shown in FIG. 2, some XY plotting systems 10 include a stationary transverse bar 40 that only allows the inkjet head 50 to move laterally along the stationary transverse bar 40; for these systems, the emulsion coated screen 60 moves along the longitudinal axis A-A. Exemplary embodiments of these printers include the KIWO XTS printer. For either embodiment, a command processor 4 within the existing CTS inkjet printer 20 controls the internal motors actuators of the XY plotting system 10 in order to position the inkjet head 50 at a particular position over the emulsion screen 60 in order to create a positive image of the digital image on the emulsion screen 60.

Figure 4:
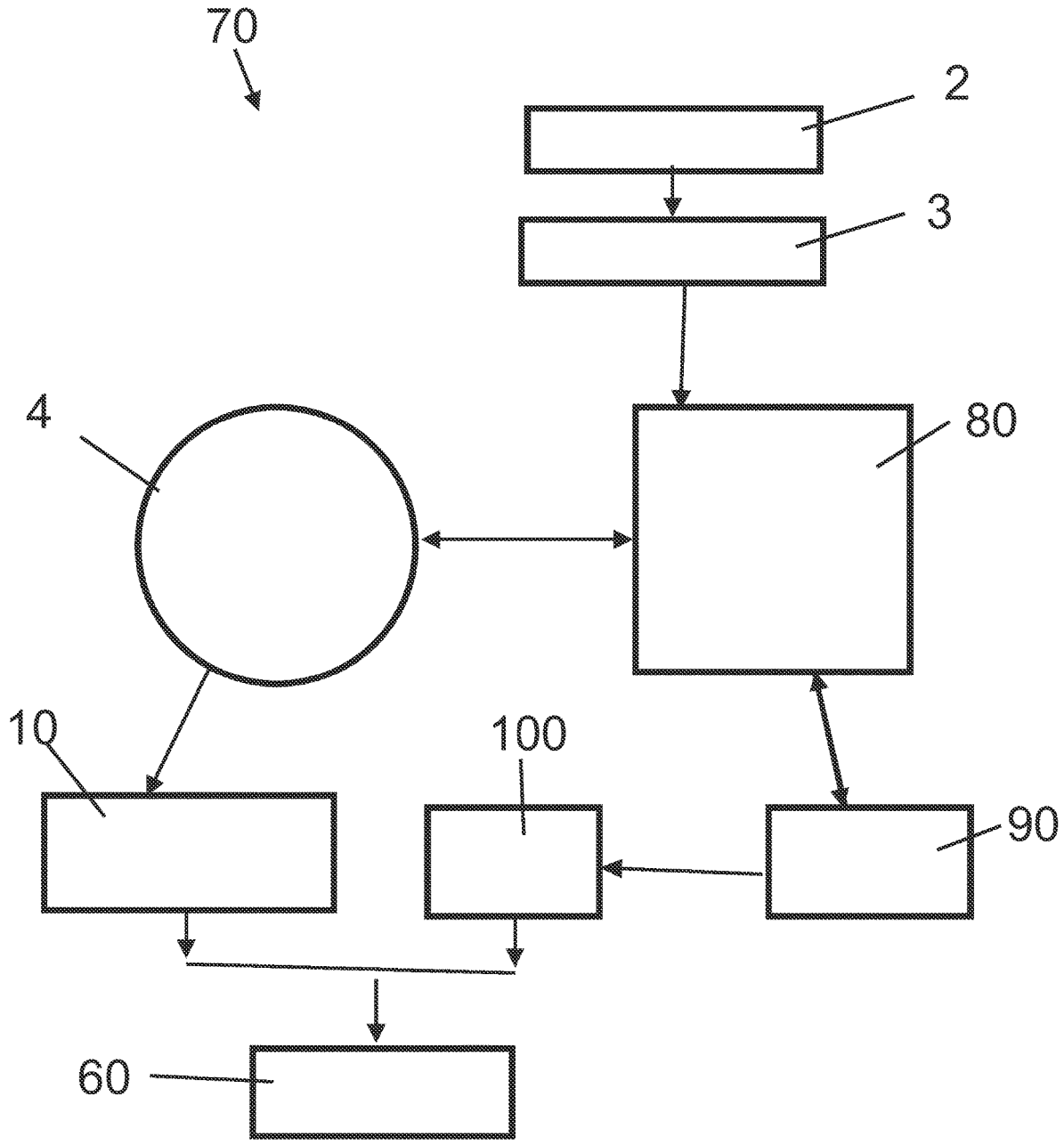
FIG. 4 depicts a system for a computer-to-screen printer in the prior art showing the retrofit kit installed in the system.

Turning to FIG. 4, a system view of the retrofit kit 70 installed in an existing inkjet CTS printer 20 is shown. The kit 70 includes a control module 80 and printhead module 90 that are in communication with each other, and a retrofit printhead 100 that is operable to replace the existing inkjet head 50.

The control module 80 is operable to receive the raster image and determines the required coordinates and light pulses needed at each coordinate. Unlike existing inkjet printers 20, in order to create the negative image necessary for laser printing, the control module 80 includes software that generates coordinates for emitting light on the emulsion screen 60 where the digital image is absent. These coordinates are then communicated to an existing processor in the CTS that controls the motors and actuators of the XY plotting system 10 to position the inkjet head at a particular position over the emulsion coated screen 60.

The retrofit printhead 100 replaces the inkjet head 50 used in existing CTS printers 20 to provide a means for emitting light onto the emulsion coated screen 60. The retrofit printhead 100 is configured to attach and be integrated into the existing XY plotting system 10. The retrofit printhead is operable to emit light for predetermined amount of time and intensity.

The printhead module 90 is operable to control the output of the retrofit printhead 100. The printhead module 90 receives the command signals from the command module 80 that determine the duration and intensity of light that is to be emitted from the retrofit printhead 100. The printhead module 90 interfaces with the retrofit printhead 100 to ensure that light is emitted from the retrofit printhead 100 in accordance with the command signals sent from the command module 80.

The printhead module 90 and the control module 80 can be implemented using a single processor or a plurality of processors, micro-processors, or controllers.

As shown in FIGS. 5-10, there are several exemplary embodiments that provide the means for emitting light from the retrofit printhead 100.

Figure 5:
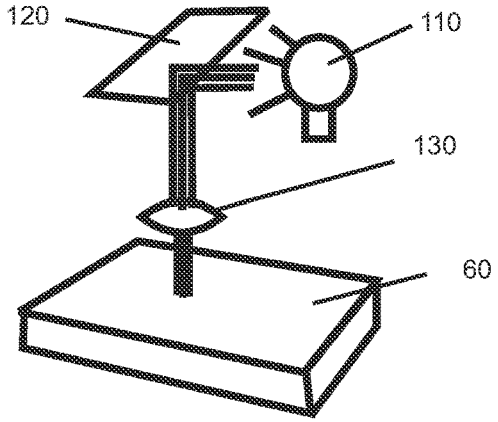
FIG. 5 depicts one embodiment of the light emitting technology included in the retrofit printhead.

FIG. 5 depicts one exemplary embodiment that provides a means for emitting light from the retrofit printhead 100. This embodiment includes a light source 110, a digital micromirror device 120, and a focus lens 130. The micromirror 120 is operable to modulate the light in the form of an image segment that is then projected through the focus lens 130 onto the emulsion coated screen 60.

Figure 6:
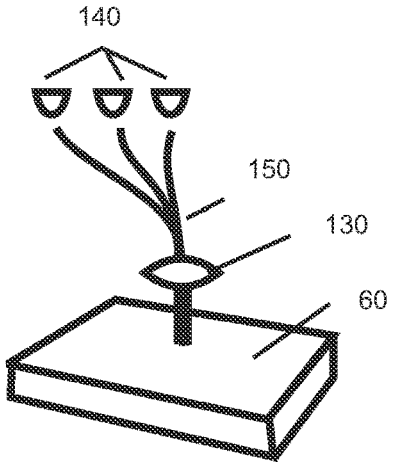
FIG. 6 depicts another embodiment of the light emitting technology included in the retrofit printhead.

FIG. 6 depicts an alternative exemplary embodiment that provides a means for emitting light from the retrofit printhead 100. This embodiment includes a plurality of light emitting or laser diodes 140 operable to emit light, a focus lens 130 operable to project the light onto the emulsion coated screen 60, and a plurality of fiberoptic threads 150 operable to transmit light from the diodes 140 to the focus lens 130.

Figure 7:
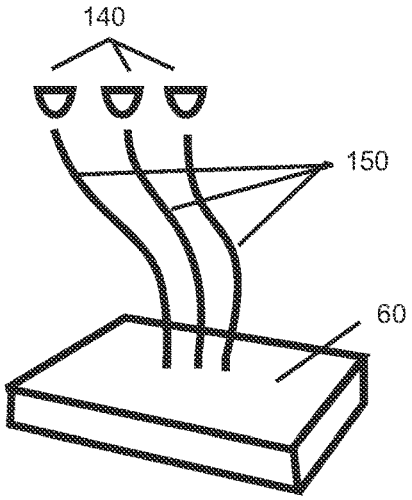
FIG. 7 depicts another embodiment of the light emitting technology included in the retrofit printhead.

FIG. 7 depicts an alternative exemplary embodiment that provides a means for emitting light from the retrofit printhead 100. This embodiment includes a plurality of light emitting or laser diodes 140 attached to a plurality of fiberoptic threads 150 operable to transmit light onto an emulsion coated screen 60.

Figure 8:
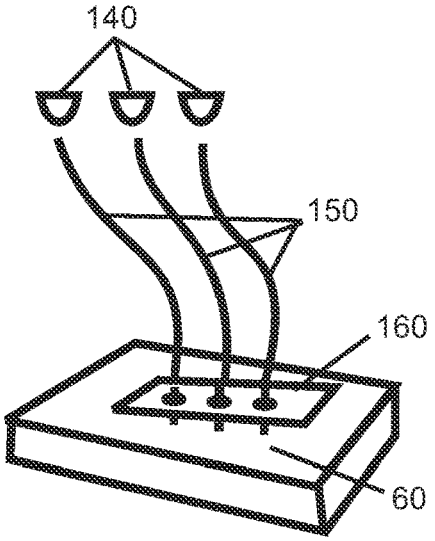
FIG. 8 depicts another embodiment of the light emitting technology included in the retrofit printhead.

FIG. 8 depicts an alternative exemplary embodiment that provides a means for emitting light from the retrofit printhead 100. This embodiment includes a plurality of laser diodes 140 attached to a plurality of fiberoptic threads 150 operable to transmit light from the laser diodes 140 through an orifice plate 160 onto an emulsion coated screen 60.

Figure 9:
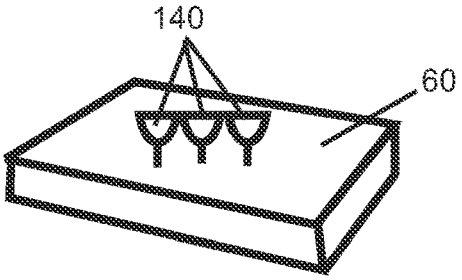
FIG. 9 depicts another embodiment of the light emitting technology included in the retrofit printhead.

FIG. 9 depicts an alternative exemplary embodiment that provides a means for emitting light from the retrofit printhead 100. This embodiment includes a plurality of laser diodes 140 operable to transmit light directly onto an emulsion coated screen 60.

Figure 10:
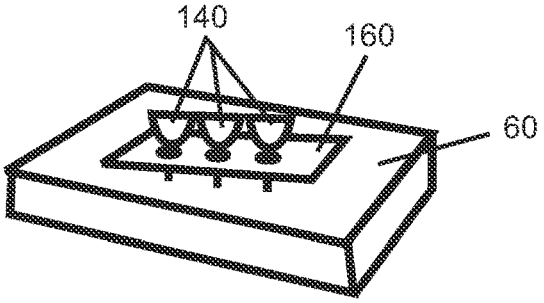
FIG. 10 depicts another embodiment of the light emitting technology included in the retrofit printhead.

FIG. 10 depicts an alternative exemplary embodiment that provides a means for emitting light from the retrofit printhead 100. This embodiment includes a plurality of laser diodes 140 operable to transmit light from the laser diodes 140 through an orifice plate 160 onto an emulsion coated screen 60.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A kit for retrofitting a computer to screen ink-jet printer to include light imaging, said kit comprising:

a control module operable to communicate with an existing command processor within said computer to screen ink jet printer, wherein said command processor provides a digital image for plotting said digital image using an ink-jet printer to said control module, and wherein said control module is operable to receive said digital image and determine the light emitting coordinates and light pulses required to produce a negative of said digital image on an emulsion coated screen;

a retrofit printhead adapted to attach to an existing XY plotting system within said computer to screen ink-jet printer and replace an existing inkjet head within said computer to screen ink-jet printer, said retrofit printhead comprising a means for emitting light onto said emulsion coated screen; and a printhead module operable to control said retrofit printhead;

wherein said existing command processor is operable to control said XY plotting system, wherein said control module is operable to communicate with said existing command processor to move the retrofit printhead to a position using said XY plotting system based on the light emitting coordinates and corresponding light pulses, wherein the control module interfaces with the printhead module to provide the light pulses at each said light emitting coordinate, and wherein the printhead module controls the retrofit printhead such that said light pulses are emitted from said retrofit printhead at said light emitting coordinates on said emulsion coated screen.

2. The kit of claim 1 wherein said XY plotting system is operable to move said retrofit printhead along a longitudinal and lateral axis of said emulsion coated screen.

3. The kit of claim 1 wherein said existing computer to screen ink-jet printer is operable to move said emulsion coated screen along a longitudinal axis and said existing XY plotting system is operable to move said retrofit printhead along a lateral axis.

4. The kit of claim 1 wherein the retrofit printhead comprises a light source, a digital micromirror device, and a focus lens, wherein said light source is operable to emit light towards said digital micromirror, wherein said digital micromirror is operable to modulate the light in form of an image segment that is projected through said focus lens to create a negative print of said digital image on said emulsion coated screen.

5. The kit of claim 1 wherein the retrofit printhead comprises a plurality of laser diodes operable to emit light, a focus lens, and a plurality of fiberoptic threads operable to transmit light from said plurality of laser diodes to a focus lens.

6. The kit of claim 1 wherein the retrofit printhead comprises a plurality of laser diodes operable to emit light and a plurality of fiberoptic threads operable to transmit light from said plurality of laser diodes onto said emulsion coated screen.

7. The kit of claim 1 wherein the retrofit printhead comprises a plurality of laser diodes, a plurality of fiberoptic threads operable to transmit light from said plurality of laser diodes to said emulsion coated screen, and a orifice plate operable to receive the distal ends of the plurality of fiberoptic threads.

8. The kit of claim 1 wherein said retrofit printhead comprises a plurality of laser diodes operable to transmit light onto said emulsion coated screen.

9. The kit of claim 1 wherein the retrofit printhead comprises a plurality of laser diodes operable to transmit light onto said emulsion coated screen, and an orifice plate comprising apertures operable to focus the light from said plurality of laser diodes onto said emulsion coated screen.

* * * * *